United States Patent [19]

Reichardt et al.

[11] Patent Number: 4,684,197

[45] Date of Patent: Aug. 4, 1987

[54] PLUG-IN CONNECTOR AND CONTACT ELEMENT FOR SAME

[75] Inventors: Manfred Reichardt, Weinsberg; Gunter Schutzle, Heilbronn, both of Fed. Rep. of Germany

[73] Assignee: Allied Corporation, Morris Township, N.J.

[21] Appl. No.: 644,468

[22] Filed: Aug. 27, 1984

[30] Foreign Application Priority Data

Sep. 7, 1983 [DE] Fed. Rep. of Germany ..... 3332319
Jun. 22, 1984 [DE] Fed. Rep. of Germany ..... 3423176

[51] Int. Cl.[4] ..... H01R 4/24
[52] U.S. Cl. ..... 439/404; 439/608
[58] Field of Search ..... 339/14 R, 14 P, 97 R, 339/97 P, 98, 99 R, 143 R

[56] References Cited

U.S. PATENT DOCUMENTS

| | | | |
|---|---|---|---|
| 2,682,647 | 6/1954 | Smith | 339/99 R |
| 3,337,834 | 8/1967 | Godwin et al. | 339/143 R |
| 3,990,767 | 11/1976 | Narozny | 339/198 |
| 4,428,637 | 1/1984 | Worth | 339/99 |
| 4,458,967 | 7/1984 | King et al. . | |
| 4,464,002 | 8/1984 | Suzuki et al. | 339/99 R |
| 4,470,655 | 9/1984 | Kalka et al. | 339/99 R |
| 4,508,410 | 4/1985 | Canham | 339/99 R |
| 4,603,475 | 8/1986 | Schutzle . | |

FOREIGN PATENT DOCUMENTS

| | | |
|---|---|---|
| 0017330 | 10/1980 | European Pat. Off. . |
| 0043183 | 5/1981 | European Pat. Off. . |
| 0068888 | 1/1983 | European Pat. Off. . |
| 1834577 | 7/1961 | Fed. Rep. of Germany . |
| 2626631 | 6/1976 | Fed. Rep. of Germany . |
| 2939302 | 9/1979 | Fed. Rep. of Germany . |
| 8107135.3 | 3/1981 | Fed. Rep. of Germany . |
| 645795 | 11/1950 | United Kingdom . |
| 839175 | 6/1960 | United Kingdom . |
| 995417 | 6/1965 | United Kingdom . |
| 1076145 | 7/1967 | United Kingdom . |
| 1450359 | 9/1976 | United Kingdom . |
| 1569379 | 6/1980 | United Kingdom . |
| 1602742 | 11/1981 | United Kingdom . |
| 2078450 | 1/1982 | United Kingdom . |
| 2083295 | 3/1982 | United Kingdom . |
| 2101422 | 1/1983 | United Kingdom . |
| 2106727 | 4/1983 | United Kingdom . |

*Primary Examiner*—Joseph H. McGlynn
*Attorney, Agent, or Firm*—Roger H. Criss

[57] ABSTRACT

A plug-in connector having an insulating element for accommodating a plurality of contact elements, each of which comprises a terminal part connected by way of a middle part to a connecting part, this being connectable for example to a cable, wherein each middle part comprises at least two legs which overlap one another. A strain relief strap is provided which provides strain relief and grounds the shielding of the flat cable.

14 Claims, 10 Drawing Figures

PLUG-IN CONNECTOR AND CONTACT ELEMENT FOR SAME

DESCRIPTION

BACKGROUND OF THE INVENTION

1. Field of the Invention

The invention relates to a plug-in connector and more particularly to a plug-in connector of the so-called trapezoidal type. The invention further relates to a contact element, and more particularly to a contact element usable in a plug-in connector, particularly of trapezoidal type.

2. Description of the Prior Art

German application No. 26 26 631 shows a plug-in connector and also a contact element therefor wherein a middle part is provided which is bendable in various ways in order to allow compensating for pitch differences, i.e. to allow mutual adaptation of the spacings of the terminal parts and the connecting parts. In this known contact element, the middle parts are bendable at the places where they are joined to the end parts. Bending is carried out in various ways substantially in the direction of the longitudinal axis of the connector, and when fitted in the connector the ends of the connecting parts take up position at various levels. Moreover, it is a disadvantage in this known construction that the connector must be of considerable overall height (in the insertion direction).

It is already known from German Utility Model 81 07 135.3 to construct contact elements in the manner of crank arms, i.e. connecting portions which project outwards from contact parts in the direction towards the connector side wall, and then fork contacts project upwards from the connecting portions. In this way, compensation of pitch is made possible, but one result is that the connector is given a considerable width, since the use of the connecting portions requires the fork contacts to come to be situated near the side walls. A further disadvantage is that the fork contacts are situated not on a straight line but instead on a curved line, which involves difficulties as regards the attaching of the contacts to the punching strip at that region.

It would be desirable to provide a plug-in connector which alleviated the above problems, in particular in connectors of the trapezoidal type that be attached to flat cables by the insulation displacement technique.

SUMMARY OF THE INVENTION

In accordance with this invention, there is provided a plug-in connector comprising an insulating element for accommodating a plurality of contact elements, each of the contact elements comprising a terminal part, a connecting part and a middle part connecting the terminal part to the connecting part, characterized in that the middle part of each contact comprises at least two legs which overlap one another. Preferably, the middle part is bent over to a substantially U-shaped form, so that the two legs form the legs of a U. In addition, preferably the two legs are located substantially one above the other.

Also in accordance with this invention, there is provided a contact element for a plug-in connector, the contact element having a terminal part, a connecting part and a middle part connecting the terminal part to the middle part, characterized in that the middle part is formed as a bulge. Preferably, the bulge has a U-shaped form.

Further in accordance with this invention, there is provided a connector for the termination of a flat cable having shielding, the connector comprising a housing and an insulating element supporting contact elements, characterized by strain relief means which provide for a strain relief of the flat cable and also ground the shielding of the flat cable. Preferably, the strain relief means is in the form of a spring strap.

This invention thus provides a connector which is relatively small in height and in which the contacts are located on a straight line, as well as a connector with improved strain relief.

DESCRIPTION OF THE PREFERRED EMBODIMENT

Figure 1:
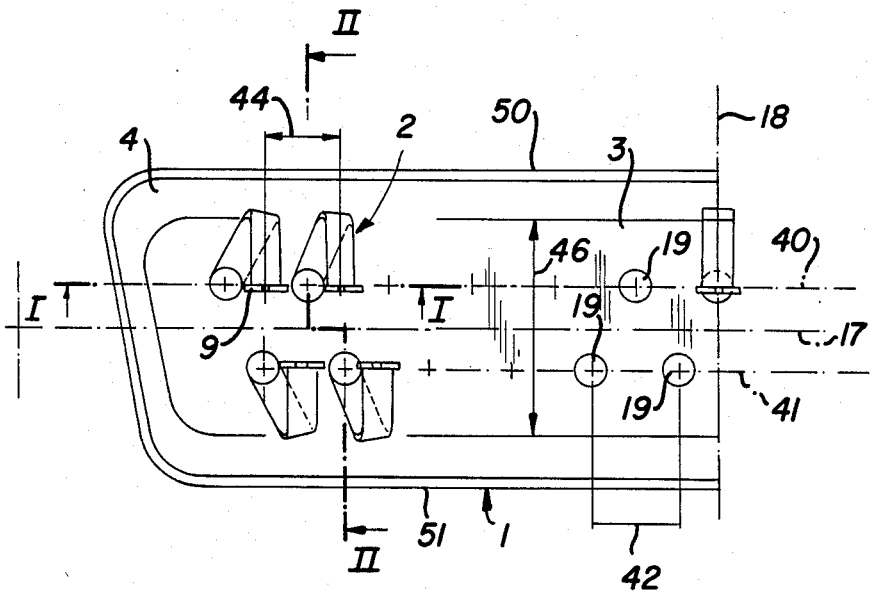
FIG. 1 shows a diagrammatic plan view of the terminal side of a plug-in connector which is of trapezoidal form overall and of which only one half is illustrated.
Figure 2:
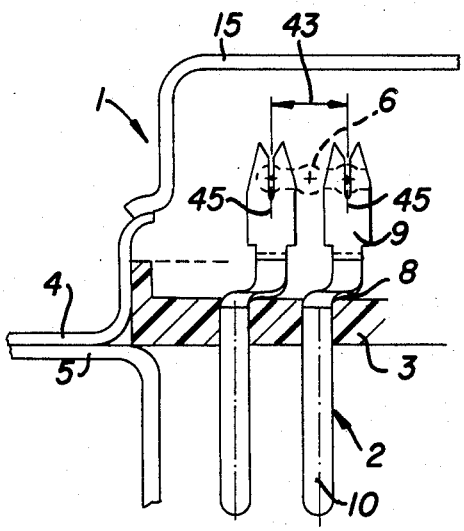
FIG. 2 shows a diagrammatic section taken substantially along the line I—I in FIG. 1.
Figure 3:
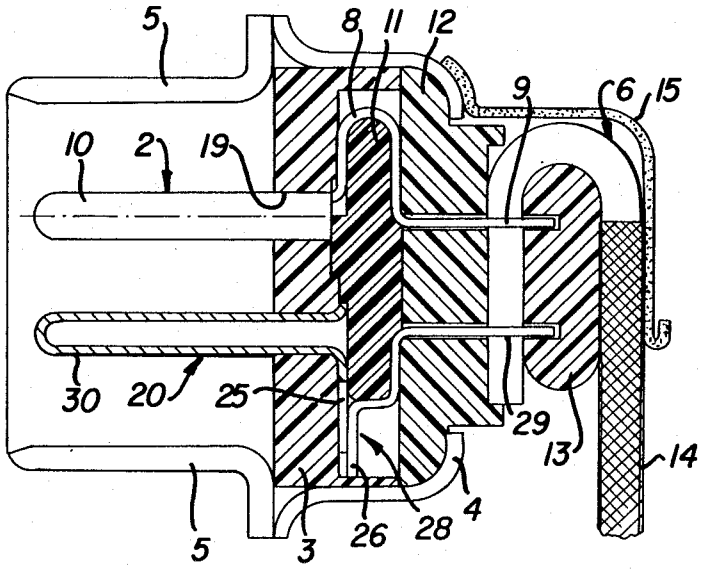
FIG. 3 shows a diagrammatic section taken substantially along the line II—II of FIG. 1.

With reference to the drawings, FIGS. 1–3 show diagrammatically a plug-in connector 1 constructed according to the invention and comprising parallel-disposed longitudinal sides 50, 51 and transverse sides which form a trapezoidal structure with the longitudinal sides, the connector using contact elements 2 constructed to the invention. The plug-in connector 1 is preferably a so-called trapezoidal plug-in connector, which term denotes the shape of the connecting face. Preferably the plug-in connector 1 according to the invention is suitable for insulation displacement connection of a flat cable 6 shown in FIG. 3.

As shown in FIGS. 1 and 3, the illustrated plug-in connector 1 has two rows of contact elements, although a larger number of rows may also be provided.

Connector 1 defines a longitudinal axis 17 and also a transverse axis 18. Extending along the longitudinal axis 17 is an insulating element 3 which comprises apertures 19 for receiving the contact elements 2. The apertures 19 are arranged along two parallel lines 40, 41 which extend parallel to the longitudinal axis 17. The center points of the apertures 19 have a pitch distance 42 which amounts to, for example, 1.37 mm. Contact elements 2 may also be arranged along three or more parallel lines.

The contact element 2, which is described below in detail, comprises a terminal part 9 and also a connecting part 10, which is connected to the terminal part 9 by means of a middle part 8 forming a bulge.

Contact elements 2 are preferably mounted with the connecting parts 10 in the aforesaid apertures 19 of the insulating element. Insulating element 3 is accommodated in a connector housing formed of a lower housing part 4 and an upper housing part 5, a preferred form of which is shown in FIG. 3. In more detail, middle parts 8 of contact elements 2 preferably extend about an insulating plate 11 and then through apertures in a holding part 12 which together with the insulating element 3 secures the insulating plate in position.

Terminal part 9 (and the terminal part 29 which is described below) is preferably constructed, as shown in the drawings, in the form of a knife terminal, so that a flat cable 6 can be connected without stripping, and preferably flat cable 6 is pressed into the position shown in FIG. 3 by means of a pressure element 13.

FIG. 3 shows that flat cable 6 is placed about the pressure element 13 in the shape of a U, and a metal strap 15 provides relief from tensile stress. Metal strap 15 also contacts the shielding 14 of flat cable 6 and places it at the same potential as lower housing part 4 in that metal strap 15 is fastened to lower housing part 4.

As can be seen more particularly from FIG. 1, each contact element 2 must be given a slightly different form as regards its middle part 8 in dependence on its lateral distance from the transverse axis 18, since the pitch 43 of the flat cable 6 (cf. FIG. 2) and the pitch distance 44 (cf. FIG. 1) of the slot centres 45 of neighbouring contact elements 2 must be adapted to the pitch distance 42 (FIG. 1) of plug-in connector 1.

FIG. 2 shows that the conductors (which are not referenced) of flat cable 6 are selectively brought into contact with contact elements 2 on the lines 40 and 41 respectively.

Figure 4:
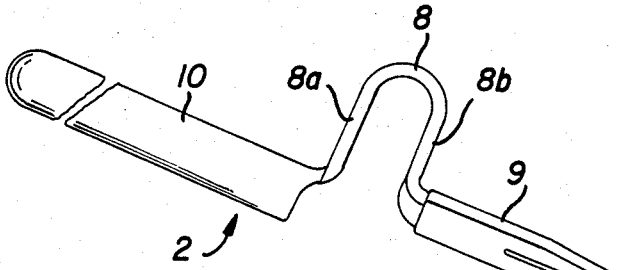
FIG. 4 shows a side view of a contact element according to the invention (pitch difference X)

According to the invention, contact element 2 as shown in FIG. 4 comprises a middle part 8 of two leg portions 8*a*, 8*b* which at least partly overlap one another with a spacing D (cf. FIG. 7), so that it is possible to achieve a small overall height 46 for plug-in connector 1 (a spacing D of 0 is also conceivable). Preferably, middle part 8 is substantially U-shaped, as shown in FIG. 7, or the U may be somewhat twisted, as FIG. 5 shows, which is required because of the arrangement shown in FIG. 1.

Due to the preferably U-form bending-over of leg portion 8*a* relatively to leg portion 8*b*, the terminal part 9 can be situated in the vicinity of or on the associated line 40 or 41 as the case may be, as FIG. 1 shows more particularly. This allows not only compensation for pitch differences (between pitch distance 42 and pitch 43 of the flat cable) but also a small overall width, which permits the use of standardised lower housing parts 4.

Figure 5:
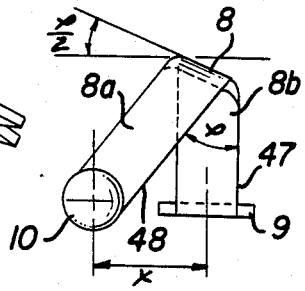
FIG. 5 shows the same contact element as in FIG. 4, seen in plan (pitch difference X is attained by angle setting $\phi$).

The contact element 2 shown in FIGS. 4 and 5 is so constructed as regards its U-shaped middle part 8 that the maximum angle $\phi$ between the edges 47, 48 (cf. FIG. 5) is formed, this being obtained where there is the maximum pitch difference X (FIG. 5). Thus the contact element shown in FIGS. 4 and 5 is the contact element 2 which is situated most outwardly on line 40 in the connector (cf. FIG. 1).

Figure 6:
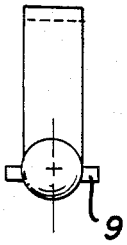
FIG. 6 is a plan view on the contact element according to the invention, but here the middle part of the contact element is bent in another way than in the case of the contact element according to FIGS. 4 and 5 (pitch difference $\phi=0$; $X=0$)
Figure 7:
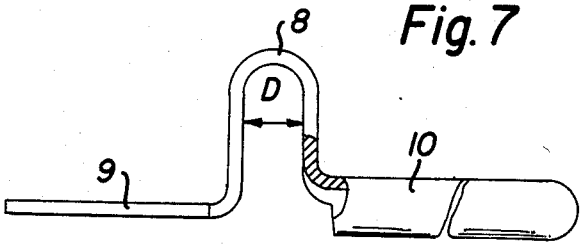
FIG. 7 shows a side view partly in section of the contact element according to FIG. 6.

FIGS. 6 and 7 show the contact element which is situated on the transverse axis 18 and whereat the angle $\phi$ is equal to 0.

Preferably, leg 8*b* extending from terminal part 9 extends at right angles i.e. parallel to the transverse axis of plug-in connector 1, whereas leg 8*a* starting from the connecting part 10 extends obliquely with respect to the transverse axis 18. However, it would also be possible for both legs 8*a*, 8*b* to extend obliquely, or for the leg 8*a* to extend at right angles and leg 8*b* obliquely. It is preferred to use the illustrated form where leg 8*b* is situated at right angles and leg 8*a* obliquely for the following reasons.

Figure 8:
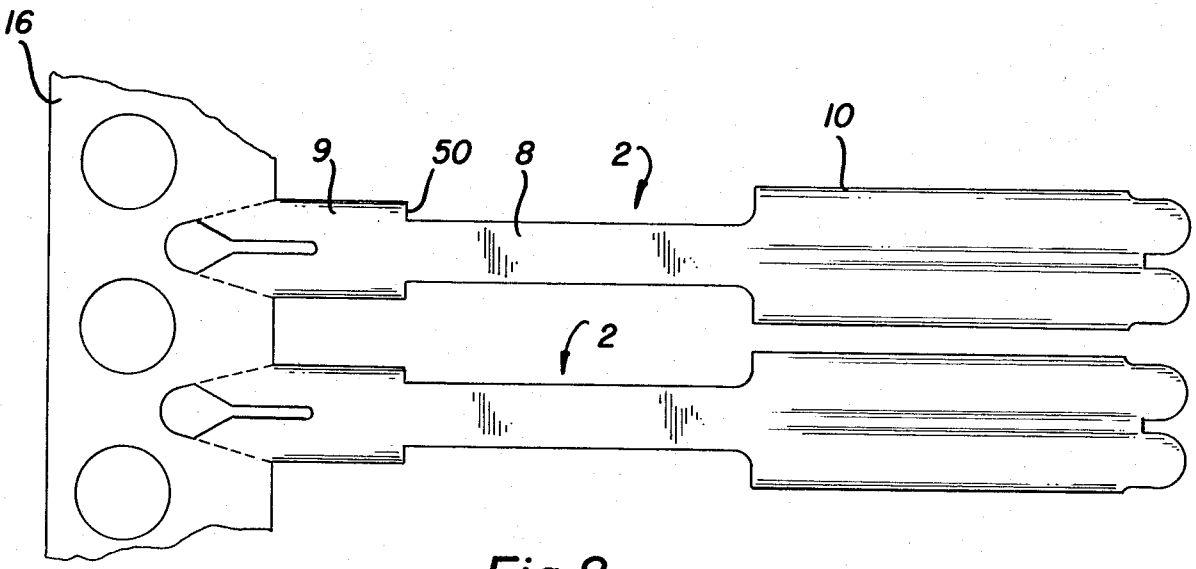
FIG. 8 shows the unfinished form of contact elements according to the invention after being punched from a sheet metal strip, of which the supporting strip part or part from which they have been punched is still visible.

The contact elements can be connected via terminal part 9 to a punching strip 16 as is illustrated in FIG. 8. In the illustrated example of embodiment according to FIG. 1 the terminal parts in the form of knife terminals preferably lie substantially on the same line 40 or 41 respectively as the center points of apertures 19. It is also possible to arrange terminal parts 9 on lines parallel to line 40 or 41. .

Moreover in the preferred example of the embodiment according to FIG. 1 it is proposed that the U-shaped middle parts 8 in each case extend towards the edge of connector 1. According to a further preferred embodiment, the U-shaped middle parts 8 extend towards longitudinal axis 17 of the connector. According to a further example of embodiment of the invention, the U-shaped middle parts of the two rows of contact elments, arranged on lines 40, 41, extend alternately towards the edge and towards longitudinal axis 17, so that the arrangement obtained for the U-shaped middle parts 8 of the two rows of contact elements 2 resembles rows of interengaging teeth.

Contact elements 2 are preferably made in one piece from sheet metal, and preferably are punched from a strip of sheet metal, giving the arrangement shown in FIG. 8 where, after the punching operation, the flat contact elements 2 still hang on supporting strip 16, from which they can finally be severed along the broken lines indicated in the Figure. In FIG. 8 the connecting part 10 is still flat, in other words it has not yet been brought to its final round shape as shown in FIG. 7. As already mentioned, the terminal part 9 is preferably made in the form of a knife terminal, which has a collar 50 (FIG. 8) with which it can abut on the holding part 12.

It should be pointed out that in the drawings the connecting part 10 is shown diagrammatically as a plug-in part, but it may also be made in the form of a socket part.

A further preferred feature of the invention is shown in the lower half of the view shown in FIG. 3. According to the invention, it is also possible to use a two-piece contact element 20 which, like contact element 2, consists of a middle part 28, a terminal part 29 and a connecting part 30. In the case of two-piece contact element 20, however, the middle part 28 is formed by having a flat tab 25 of connecting part 30 connected in each case to a flat tab 26 of terminal part 29, for example by welding. The two-piece construction has the following advantages: the terminal part 29 can be used for pin and for socket contacts, and the punching tools are simpler. Different materials can be chosen for connecting part 30 and terminal part 29.

Parts 3, 11, 12 are preferably formed of a plastic material which may be cast or extruded.

Figure 9:
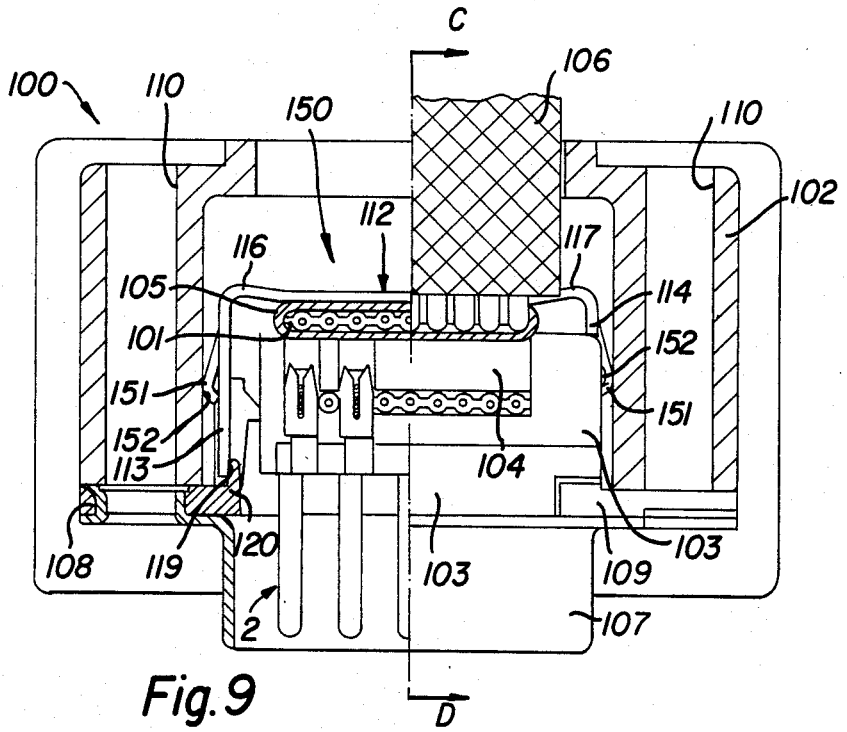
FIG. 9 is a longitudinal sectional view of another embodiment of the connector.
Figure 10:
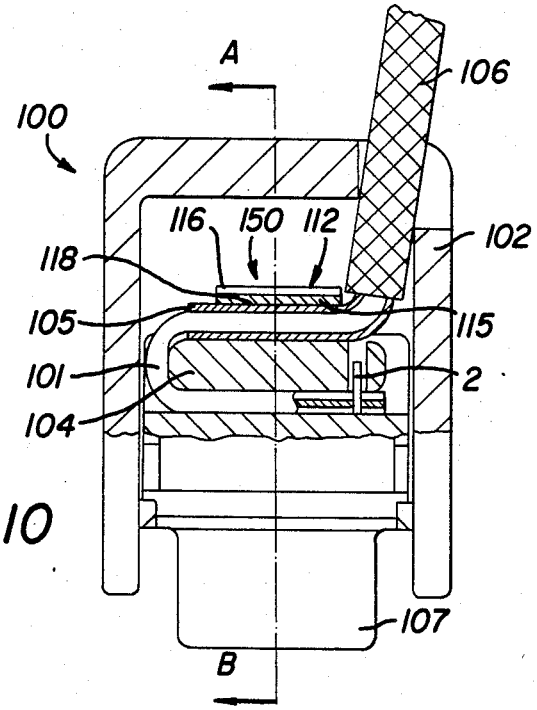
FIG. 10 is a cross-sectional view of the connector of FIG. 9.

FIGS. 9 and 10 disclose another embodiment of this invention. FIG. 9 illustrates two different longitudinal sections. The left portion of FIG. 9 is a section substantially along line A–B in FIG. 10. The right portion of FIG. 9 is obtained if the sectional line A–B in FIG. 10 is moved substantially towards the right. FIG. 10 is a cross-sectional view along line C–D in FIG. 9 of the connector 100 of the invention.

The embodiment of FIGS. 9 and 10 is a further improvement of the embodiment of FIG. 3 insofar as the strain relief strap is improved.

Connector 100 which is particularly useful for a flat cable 101 comprises in general a housing 102 in which an insulating ellement 103 is arranged. Housing 102 is preferably in the form of a single piece. Within insulating element 103 are arranged contact elements 2, as described above; however any type of contact elements may be used. Flat cable 101 (see FIG. 10) extends around a body 104 and is pressed by means of body 104 onto the terminating portions of contact elements 2 so as to provide the proper contact. A shielding 105 of flat cable 101 ends at a location where flat cable 101 is bent around body 104. In the embodiment of FIGS. 9 and 10 the cable cover 106 is cross-hatched.

Insulating element 103 is arranged with its lower end on a sheet metal front element 107 as well as on two metal flanges 108, 109 which are connected with sheet metal element 107. Metal flanges 108, 109 comprise openings, which are aligned with openings 110 in housing 102. As is well known these openings are adapted to receive bolts which may be used for providing locking enagement with the opposite connector which is not shown.

The arrangement of the different components of connector 100 may be carried out in the usual manner. Of importance, however, is the arrangment and the design of the stress relief means in the form of a strap, specifically a spring strap 150. Spring strap 150 provides on the one hand a strain relief and on the other hand makes sure that the shielding 105 is properly grounded. For this reason the spring strap 150 is made of metal. The spring strap 150 is in general U-shaped and comprises a cross portion 112 as well as two legs 113, 114. The cross portion 112 (see FIG. 10) comprises at a somewhat lower position a shielding contact portion 115 as well as two spring portions 116, 117 which are arranged diametrically opposite at shielding contact portion 115. Between the cross portion 112 and the shielding 105 a large contact area 118 is formed.

Another location of contact 119 is provided between the spring strap 150, i.e. the legs 113, 114 thereof, and the metal flanges 108, 109. For that purpose flange portions 108, 109 are preferably provided with a projection 120 and the lower ends of legs 113, 114 are in engagement with said projections 120.

As already mentioned, housing 102 is frequently made of metal or a metallized plastic material for reasons of obtaining a shielding effect. If the housing is made of a metallized plastic material a thin metallic layer may be provided at the inner surface of the housing 102. According to the invention the strain relief means in the form of spring strap 150 comprises housing contact means 152 in the form of spring arms. Each leg 113, 114 preferably has one spring arm 152. However, it is also possible to provide a plurality of spring arms for each leg 113, 114. Spring arms 152 form with the inner surface of the housing locations of contact 151 so as to provide for grounding.

In accordance with the invention spring arms 152 are formed integral with the spring strap 150. Spring arms 152 extend from legs 113, 114 outwardly in the direction towards the surface of the housing as is clearly shown in FIG. 9. When the connector 100 is in its assembled condition, the spring arms elastically abut against the inner surfaces of the housing.

The present invention thus provides a plug-in connector which alleviates the problems noted previously with respect to earlier designs. The connector results in one or more of the following advantages:

1. Full compensation is provided for the difference between the pitch of the connecting parts (1.37 mm) and the spacing (1.27 mm) of the conductors of the flat cable within the plug-in connector.

2. A low constructional form is achieved. Preferably the terminal-side overall height measured from the flange plugging side can be $\leqq 10$ mm. Both at the plugging side and at the terminal side of the plug-in connector the connecting parts (e.g. contact pins), and the terminal parts respectively, which are preferably in the form of knife terminals, are in each case situated in alignment in a straight line.

3. The row spacing of the terminal elements can be kept small. There is simply the limitation imposed by air gap and creep distance considerations. As a result, standardised metal shells can be used at the terminal side of the plug-in connector also.

This invention also makes it possible to keep the space requirements of the contact blank in the longitudinal direction of the strip to equal two times the cable pitch (2.54 mm). That is to say, the spacing of the contacts on the punching strip corresponds to the spacing of the contact terminal elements in the fitted state. As a result the contacts can be fitted in rows in the insulating element.

Moreover, the invention provides an improved design of a strain relief strap.

We claim:

1. A plug-in connector comprising:

an insulating element having a plurality of apertures for receiving a plurality of contact elements in a plurality of rows arranged substantially parallel to the longitudinal axis of said connector;

each of said contact elements comprising a terminal part, a connecting part and a middle part connecting said terminal part to said connecting part, said terminal part being in the form of a knife terminal for receiving a conductor wire of a flat cable, the spacing between terminal parts of adjacent contacts in each row of contacts being different from the spacing between connecting parts of adjacent contacts in each row of contacts, said terminal parts of said contacts in each row of contacts being arranged in a line parallel to said longitudinal axis, and said connecting parts of said contacts in each row of contacts being arranged in a line parallel to said longitudinal axis, said middle part of each of said contacts comprising two legs which overlap one another and being of a substantially U-shaped form, said two legs forming a bulge extending towards the longitudinal sides of said connector, each of said contact elements being initially formed in substantially the same configuration and being bent in said insulating element such that the two legs of said middle part of said contact elements arranged substantially in the center of said connector along said longitudinal axis are in substantial alignment whereby said terminal part and said connecting part of said centrally arranged elements are located substantially one above the other, and the two legs of said middle parts of said contact elements located the farthest from said center of said connector are angularly offset a maximum amount with respect to the two legs of said other contact elements whereby said terminal part and said connecting part of said farthest located contact elements are offset from each other the maximum amount as compared to other contact elements in the same row, and an insulating plate provided in said connector, said plate having side edges, said bulges of said middle parts of said contact elements extending over said side edges.

2. The connector of claim 1, wherein said middle parts are bent to said U-shaped form.

3. The connector of claim 1, wherein said connector has a trapezoidal connecting face.

4. The connector of claim 1, wherein said middle parts are formed by a tab of a connecting part and a tab of a terminal part, said tabs being joined to one another.

5. The connector of claim 4, wherein said tabs are welded to one another.

6. The connector of claim 1, wherein said flat cable has shielding, and said connector comprises strain relief means which provides for a strain relief of said cable and also grounds said shielding of said cable.

7. The connector of claim 6, wherein said strain relief is in the form of a spring strap.

8. The connector of claim 7, wherein said spring strap has a substantially U-shape and comprises a cross portion extending between two legs, said cross portion having a shield contact portion for contacting said shield of said cable, said legs being in grounding contact with said housing.

9. A connector for the termination of a flat cable having shielding, said connector comprising:

a housing, an insulating element in said housing;

contact elements supported in said insulating member; and strain relief means providing for a strain relief of said flat cable and also grounding of said shielding of said flat cable, said strain relief means comprising a substantially U-shaped spring strap having a cross portion extending between two legs, said cross portion comprising a shield contact portion for contacting said shielding, said legs being in grounding contact with said housing.

10. The connector of claim 9, wherein said legs of said spring strap are in grounding contact with metal flanges provided on said connector.

11. The connector of claim 10, wherein said spring strap comprises spring arms in grounding contact with the inner walls of said housing.

12. The connector of claim 11, wherein said spring arms are integral with said legs.

13. The connector of claim 12, wherein said cross portion comprises two spring portions arranged on both sides of said shield contact portion.

14. The connector of claim 13, wherein each of said contact elements comprises a terminal part, a middle part and a connecting part, said middle part having at least two legs which overlap one another and said middle part being of substantially U-shaped form.

* * * * *